United States Patent [19]

Fujiura et al.

[11] 4,367,004

[45] Jan. 4, 1983

[54] ELECTRICAL CONNECTOR

[75] Inventors: Yoshitsugu Fujiura, Tokyo; Takahiko Miyamura, Hatano; Ryoji Nishimura, Fussa, all of Japan

[73] Assignee: AMP Incorporated, Harrisburg, Pa.

[21] Appl. No.: 109,385

[22] Filed: Jan. 22, 1980

[30] Foreign Application Priority Data

Jan. 22, 1979 [GB] United Kingdom ..... 7902247

[51] Int. Cl.[3] ..... H01R 11/20

[52] U.S. Cl. ..... 339/97 R; 339/99 R

[58] Field of Search ..... 339/97 R, 98, 99 R

[56] References Cited

U.S. PATENT DOCUMENTS

| | | | |
|---|---|---|---|
| 3,142,524 | 7/1964 | McDonough | 339/98 |
| 3,444,506 | 5/1969 | Wedekind | 339/99 |
| 3,820,055 | 6/1974 | Huffnagle et al. | 339/17 F |
| 3,820,058 | 6/1974 | Friend | 339/99 R |
| 3,858,159 | 12/1974 | Worth | 339/99 R |
| 3,899,236 | 8/1975 | Santos | 339/98 |
| 3,912,354 | 10/1975 | Campbell et al. | 339/99 R |
| 4,062,616 | 12/1977 | Shaffer et al. | 339/99 R |
| 4,153,325 | 5/1979 | Asick | 339/99 R |

FOREIGN PATENT DOCUMENTS

| | | | |
|---|---|---|---|
| 52-3187 | 1/1977 | Japan | 339/99 R |

*Primary Examiner*—Eugene F. Desmond
*Attorney, Agent, or Firm*—F. Brice Faller

[57] ABSTRACT

An electrical connector for use in establishing electrical connections to the conductors of a flat cable comprises a first housing member carrying a plurality of terminals each having arms having opposed edges defining a conductor-receiving slot and having pointed extremities for piercing the insulating material of the cable, and a second housing member having a plurality of holes to receive the arms of a respective one of the terminals. The arms of the conductor-receiving portion of each terminal are formed adjacent their free ends with outwardly directed projections which are an interference fit in the associated hole in the second housing member, each arm of each terminal in use engaging the second housing member not only at the projection on the arm but also at a second position adjacent the engagement between the arm and a conductor of the cable received in the slot partially defined by the arm. The second position of engagement between each arm of each terminal and the second housing member serves to relieve the stresses induced in the arms by the engagement between the projections on the arms and the second housing member, this enhancing the contact between the arms and the conductors and ensuring reliable electrical connections.

2 Claims, 3 Drawing Figures

ELECTRICAL CONNECTOR

This invention relates to an electrical connector and particularly to an electrical connector for use in establishing electrical connections to the conductors of a flat cable of the type comprising a plurality of conductors held in spaced side-by-side parallel relationship by plastics insulating material.

In U.S. Pat. No. 3,820,055 (8233) there is described such a connector comprising a first housing member carrying a plurality of terminals each having a conductor-receiving portion projecting from one face of the first housing member, the conductor-receiving portions of all the terminals all projecting in the same direction, and each comprising a pair of spaced arms extending normally of the one face of the first housing member, the arms having opposed edges defining a conductor-receiving slot and having pointed extremities for piercing the insulating material of the cable, and a second housing member having a plurality of holes extending inwardly from one face thereof each to receive the arms of a respective one of the terminals carried by the first housing member when the two housing members are positioned with their one faces facing and with the cable located between their one faces with conductors of the cable received in the conductor-receiving slots of respective terminals, the arms of the conductor-receiving portion of each terminal being formed adjacent their free ends with outwardly directed projections which are an interference fit in the associated hole in the second housing member, the interference fit between the projections and the walls of the associated holes in the second housing member serving to latch the second housing member to the terminals and thus to the first housing member.

This known connector has the advantage that the first and second housing members are securely latched together with a cable therebetween by the engagement between the terminals and the second housing member, this preventing bowing of the second housing member, which can occur particularly with long connectors, such bowing possibly adversely affecting the connections between the terminals and the conductors of the cable.

According to this invention in use of a connector as described above each arm of each terminal engages the second housing member not only at the projection on the arm but also at a second position adjacent the engagement between the arm and a conductor of the cable received in the slot partially defined by the arm.

The connector of this invention has the advantage that the second position of engagement between each arm of each terminal and the second housing member serves to relieve the stresses induced in the arms by the engagement between the projections on the arms and the second housing member, this enhancing the contact between the arms and the conductors and ensuring reliable electrical connections.

A connector according to this invention will now be described by way of example with reference to the drawing in which.

Figure 1:
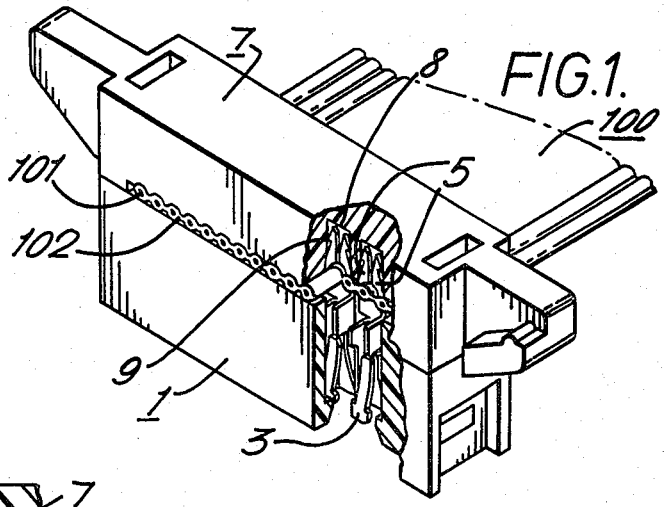
FIG. 1 is a perspective view of the connector with part broken away and connected to a cable.

The connector to be described is for connection to a flat cable 100 of the type comprising a plurality of conductors 101 held in spaced side-by-side parallel relationship by plastics insulating material 102, and comprises a first housing member 1 moulded from electrically insulating plastics material and carrying a plurality of terminals 2 each stamped and formed from sheet metal and having a socket portion 3 contained in the housing member 1 for mating with a male contact (not shown), and a conductor-receiving portion 4 projecting from one face of the housing member 1, the conductor-receiving portions 4 of all the terminals 2 (only one being shown in FIGS. 2 and 3) projecting in the same direction.

Each conductor-receiving portion 4 comprises a pair of spaced arms 5 extending normally of the one face of the housing member 1, the arms 5 having opposed edges defining a conductor-receiving slot 6, and having pointed extremities for piercing the insulating material 102 of the cable 100.

The connector also comprises a second housing member 7 moulded from electrically insulating plastics material and having a plurality of blind holes 8 extending inwardly from one face thereof each to receive the arms 5 of a respective one of the terminals 2 when the two housing members 1 and 7 are positioned with their one faces facing and with the cable 100 located between their one faces with the conductors 101 of the cable 100 received in the conductor-receiving slots 6 of respective terminals 2.

Figure 3:
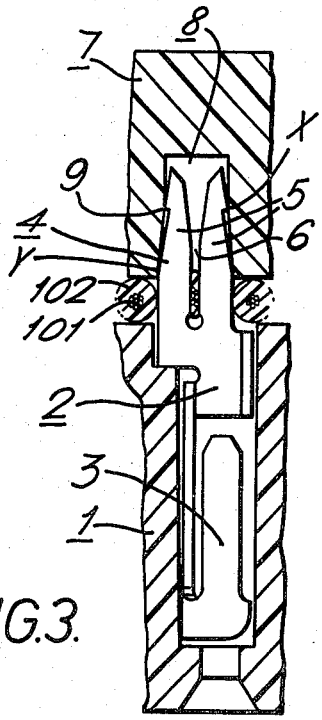
FIG. 3 is a view similar to FIG. 2 but with the connector in the assembled state.

The arms 5 of each terminal 2 are formed adjacent their free ends with outwardly directed projections 9 which are an interference fit in the associated hole 8 in the second housing member 7, the projections 9 biting into the wall of the associated hole 8 and thus serving to latch the second housing member 7 to the terminals 2 and thus to the first housing member 1 in the assembled state shown in FIGS. 1 and 3.

Figure 2:
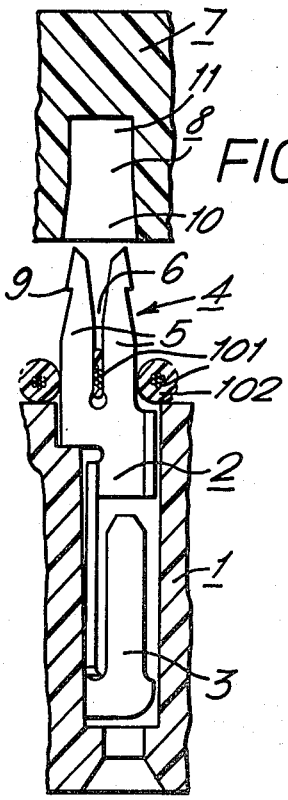
FIG. 2 is a sectional view of part of the connector prior to assembly to a cable.

As clearly shown in FIG. 2 each hole 8 has a first portion 10 of inwardly tapering cross-section, which serves to cam the arms 5 of the associated terminal 2 towards each other as the second housing member 7 is applied to the terminals 2, the tapering portion 10 leading into a second portion 11 of constant cross-section which serves to hold the arms 5 in a stressed condition (shown in FIG. 3) with a conductor 101 received between them, and with the projections 9 biting into the wall of the hole 8. The projection 9 on each arm 5 thus defines a first position X of engagement between the arm 5 and the second housing member 7.

As previously mentioned, this engagement X and the stresses it causes in the arms 5 can adversely affect the contact between the arms 5 and the associated conductor 101, and thus in the connector of this invention the arms 5 and the hole 8 in the second housing member 7 are so dimensioned that there is a second position Y of engagement between each arm 5 and the second housing member 7 at the mouth of the hole 8, that is adjacent the engagement between the arm 5 and the conductor 101 received in the slot 6 partially defined by the arm 5, as clearly shown in FIG. 3.

It has been found by stress analysis carried out on a connector according to this invention that the provision of the second position Y of engagement between each arm 5 and the second housing member 7 serves to reduce and disperse the stress concentrations in the arm 5 caused by the first position X of engagement between the projection 9 on the arm 5 and the second housing member 7, and between the arms 5 and the conductor 101, thereby enhancing the contact between the arms 5 and the associated conductor 101 while still maintaining the latching effect between projection 9 on the arms 5 and the second housing member 7.

What is claimed is:

1. An electrical connector for use in establishing electrical connections to the conductors of a flat cable of the type comprising a plurality of conductors held in spaced side-by-side parallel relationship by plastics insulating material, comprising a first housing member carrying a plurality of terminals each having a conductor-receiving portion projecting from one face of the first housing member, the conductor-receiving portions of all the terminals all projecting in the same direction, and each comprising a pair of spaced arms extending normally of the one face of the first housing member, the arms having opposed edges defining a conductor-receiving slot and having pointed extremities for piercing the insulating material of the cable, and a second housing member having a plurality of holes extending inwardly from one face thereof each to receive the arms of a respective one of the terminals carried by the first housing member when the two housing members are positioned with their one faces facing and with the cable located between their one faces with conductors of the cable received in the conductor-receiving slots of respective terminals, the arms of the conductor-receiving portion of each terminal being formed adjacent their free ends with outwardly directed projections which are an interference fit in the associated hole in the second housing member, the interference fit between the projections and the walls of the associated holes in the second housing member serving to latch the second housing member to the terminals and thus to the first housing member, in which in use, each arm of each terminal engages the second housing member not only at the projection on the arm but also at a second position adjacent the engagement between the arm and a conductor of the cable received in the slot partially defined by the arm whereby stress concentrations at said second position of engagement which are caused by the engagement at the projection on the arm, are dispersed into the plastics insulating material and contact between the arms and the conductor is improved.

2. A connector as claimed in claim 1, in which each hole in the second housing member is a blind hole having a first portion of inwardly tapering cross-section, leading into a second portion of constant cross-section in which the projections on the arms of the associated terminal are received in the assembled state of the connector.

* * * * *

Disclaimer 4,367,004.—*Robert M. Booth, Jr.*, Wappingers Falls; *Chester A. Wasik*, Poughkeepsie, both of N.Y. SITU RATE AND DEPTH MONITOR FOR SILICON ETCHING. Patent dated Jan. 4, 1983. Disclaimer filed Mar. 11, 1985, by the assignee, *International Business Machines Corp.*

Hereby enters this disclaimer to claims 1–11 of said patent.

[*Official Gazette April 30, 1985.*]